US006348763B1

(12) United States Patent
Collins

(10) Patent No.: US 6,348,763 B1
(45) Date of Patent: Feb. 19, 2002

(54) FLUORESCENT LAMP LUMINAIRE SYSTEM

(75) Inventor: Byron R. Collins, Tuxedo, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/564,135

(22) Filed: May 3, 2000

(51) Int. Cl.[7] ..... H01J 17/16

(52) U.S. Cl. ..... 313/634; 313/635; 313/485; 362/216; 315/363

(58) Field of Search ..... 313/634, 635, 313/642, 487, 486, 113, 493; 315/248, 57, 149, 150–159, 485, 489, 363; 362/339, 216

(56) References Cited

U.S. PATENT DOCUMENTS

| | | | | | |
|---|---|---|---|---|---|
| 4,005,330 | A | | 1/1977 | Glascock, Jr. et al. | 315/57 |
| 4,099,090 | A | * | 7/1978 | Corth et al. | 313/487 |
| 4,245,179 | A | | 1/1981 | Buhrer | 315/248 |
| 5,211,467 | A | | 5/1993 | Seder | 362/84 |
| 5,235,497 | A | * | 8/1993 | Costa | 362/224 |
| 5,479,069 | A | * | 12/1995 | Winsor | 313/493 |
| 5,579,134 | A | * | 11/1996 | Lengyel | 359/49 |
| 5,602,444 | A | | 2/1997 | Jansma | 313/489 |
| 5,607,222 | A | * | 3/1997 | Woog | 362/84 |
| 5,726,528 | A | * | 3/1998 | Jansma et al. | 313/489 |
| 5,952,792 | A | | 9/1999 | Borowiec et al. | 315/248 |
| 5,959,405 | A | | 9/1999 | Soules et al. | 313/635 |
| 6,135,620 | A | * | 10/2000 | Marsh | 362/377 |

* cited by examiner

*Primary Examiner*—Don Wong
*Assistant Examiner*—Tuyet T. Vo
(74) *Attorney, Agent, or Firm*—Fay, Sharpe, Fagan, Minnich & McKee, LLP

(57) ABSTRACT

The invention comprises a fluorescent lamp system wherein an ultraviolet producing discharge tube contains no phosphor internal to the tube. Rather an insert or sleeve physically distinct from the tube includes a phosphor. The layer insert or sleeve further includes an ultraviolet filter, preferably in the form of an ultraviolet reflective/visible light transmissive layer positioned to reflect ultraviolet energy that is not converted to visible light on a previous pass through the phosphor, back toward the phosphor. It has many embodiments.

18 Claims, 4 Drawing Sheets

FLUORESCENT LAMP LUMINAIRE SYSTEM

BACKGROUND OF THE INVENTION

1. Field of the Invention

The present invention relates to fluorescent lamps and, in particular, to a long life, high efficiency fluorescent lighting system in which the phosphor is coated on a surface external to the lamp and an ultraviolet reflective layer is used to prevent hazardous ultraviolet rays from escaping the light source.

2. Description of Related Art

Existing fluorescent lamps have limitations in performance and lifetime that are undesirable. A typical mercury vapor (Hg) fluorescent lamp includes a phosphor coating on the inside surface of a glass tube. When the Hg vapor is ionized inside the tube, the lamp discharge emits radiation, including ultraviolet, that in converted to visible light by the phosphor coating.

The performance of a standard fluorescent lamp suffers from several shortcomings inherent in its basic design. In particular, the phosphor coating on the inside surface of a fluorescent tube is exposed to heat and mercury. This exposure can degrade or poison the phosphors. Furthermore, where filaments are used to provide power to the lamp, the filaments can evaporate. This leads to a reduction in light output, and ultimately filament and lamp failure.

Using a thicker phosphor layer can extend the life of the phosphor coating. However, a thick phosphor layer reflects light much better than it transmits light. Thus, in applying the phosphor coating to the inside of a fluorescent tube, there is a trade-off between a thin coating that transmits light more efficiently versus a thick coating that provides a longer lifetime.

Filament evaporation and phosphor poisoning are two failure modes for prior art fluorescent lamps. An invention that addresses these failure modes would work to extend the lifetime of the lamp. In a system including such a lamp, the lamp ballast would become the component with, potentially, the shortest lifetime and therefore the most likely component to require replacement. It would be beneficial, therefore, for the task of ballast replacement to be made simple.

BRIEF SUMMARY OF THE INVENTION

The invention comprises a fluorescent lamp system wherein an ultraviolet producing discharge lamp contains no phosphor internal to the tube. Rather a cover, housing or sleeve physically distinct from the lamp includes a phosphor. The cover or sleeve further includes an ultraviolet filter, preferably in the form of an ultraviolet reflective/visible light transmissive layer positioned to reflect ultraviolet energy that is not converted to visible light on a previous pass through the phosphor, back toward the phosphor. It has many embodiments. The preferred embodiments are described below.

BRIEF DESCRIPTION OF THE SEVERAL VIEWS OF THE DRAWINGS

The Figures are for illustration only and are not to scale.

DETAILED DESCRIPTION OF THE INVENTION

Figure 1:
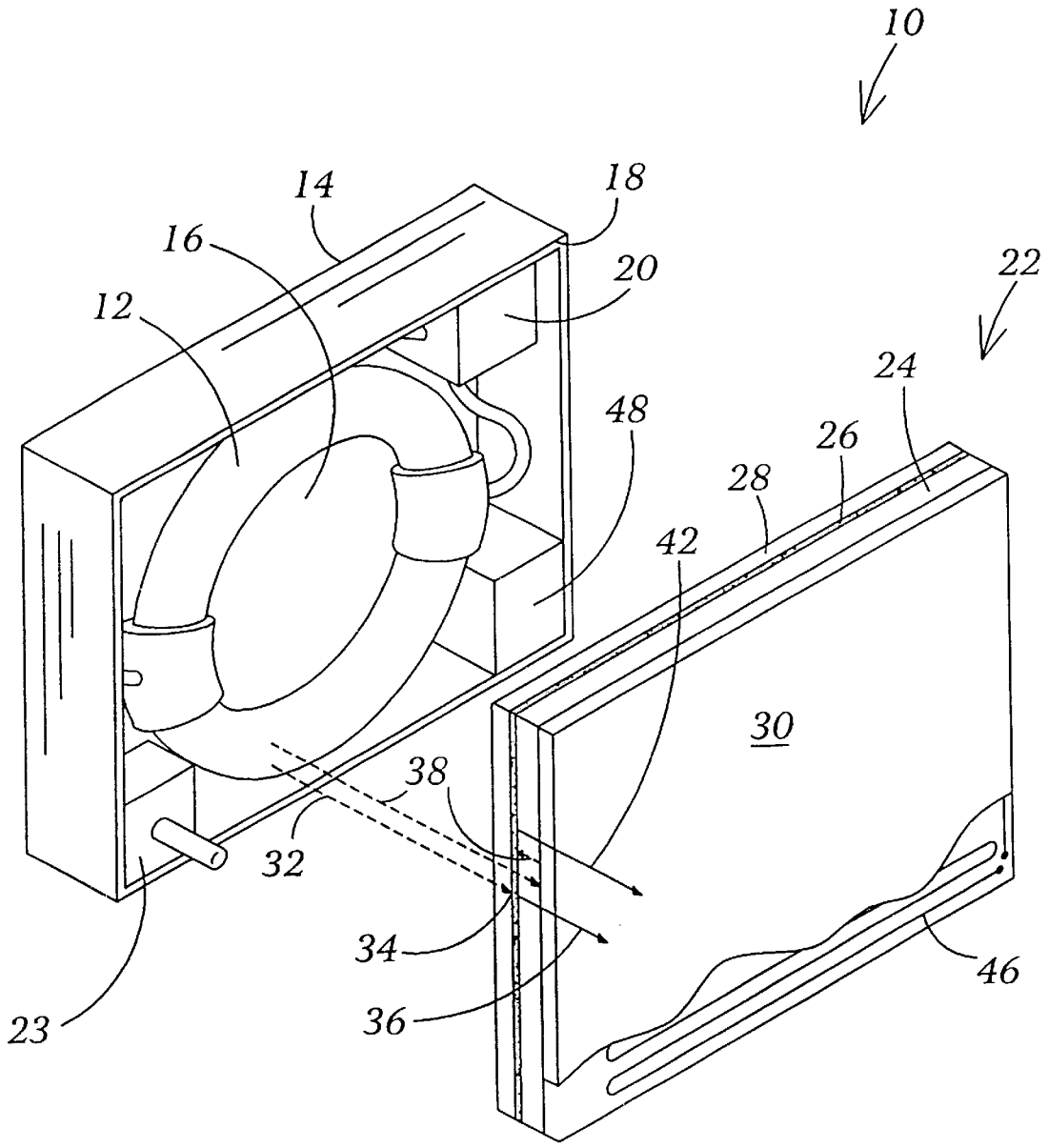
FIG. 1 illustrates a first lamp system that is an embodiment of the present invention, including an housing/reflector and a cover, the cover has several layers, including, an ultraviolet transmissive/visible light reflective layer, a phosphor coating on a substrate, and an ultraviolet reflective/visible light transmissive layer on another side of the substrate.

Referring now to FIG. 1, depicted is a first lighting system 10 having a discharge lamp 12, of an electrodeless ultraviolet producing type, enclosed in a housing or reflector 14 having a back wall 16 and sidewalls 18. At least portions of the backwall 16 and/or the sidewalls 18 have reflective characteristics designed to direct the path of light. An electronic circuit 20 for driving the lamp 12 is also enclosed in the housing 14. The electronic circuit can be a discharge lamp ballast. In one embodiment it is a plug-in type ballast or plug in type lamp drive circuit, a feature of the driving circuit 20 is that if it fails it can be quickly and easily replaced.

Also included in lighting system 10 is cover 22. The housing 14 and cover 22 include connections (not shown) such as, for example, a set of fasteners with a special alignment, or a housing and cover keyway system for preventing the cover 22 from being installed backwards. Optionally the housing 18 and cover 22 include a safety mechanism, such as a switch or lockout device 23 that enables lamp operation when the cover 22 is properly installed, and disables the discharge lamp 12 when the cover 22 is removed, thereby preventing the exposure of maintenance personnel or others to harmful ultraviolet light.

The cover 22 in this embodiment, is a four-layered device. A substrate or central layer 24 has an inner surface that is relatively close to the lamp 12 and an outer surface that is further from the lamp. The inner surface of the substrate 24 carries a second layer comprising a phosphor coating 26. A third layer 28, comprising an ultra-violet (UV) transmissive/visible light reflective layer or coating, covers the phosphor coating 26. When the cover 22 is properly installed, the third layer 28 is the layer nearest the lamp 12. The outer surface of the substrate 24 carries a fourth layer comprising a UV reflective/visible light transmissive layer or coating 30.

Alternatively, the phosphor coating is carried by the outer surface of the substrate. In that case the third layer or coating is carried directly by the inner surface of the substrate and the fourth layer or coating covers the phosphor layer. Of course, phosphor may coat both the inner and outer surface of the substrate. In that case the third and forth layers cover respective layers of phosphor coating. As will be understood from a reading of a description of the paths of UV and visible light below, the cover assembly is operative to sandwich the phosphor coating between the third or ultra-violet transmissive/visible light reflective layer and the forth or ultra-violet reflective/visible light transmissive layer so that visible light is directed toward the area to be lit and ultra-violet light is directed toward the phosphor coating. Preferably, ultra-violet light is prevented from escaping the lighting system.

With further attention to lamp 12, in this embodiment, it is an electrodeless lamp with no phosphor coatings on the interior or exterior surfaces of the lamp. Such a design results in substantially unadulterated UV light waves being emitted from the lamp 12 upon energization by ballast 20.

When UV light 32 is emitted from lamp 12, it initially passes through the UV transmissive/visible light reflective layer coating or layer 28. The UV light then impinges on phosphor layer 26 at point 34, causing the phosphor in phosphor layer 26 to be excited, generating a visible light 36 which is output through substrate 24 and fourth layer 30.

It is possible that not all of the UV light from lamp 12 is converted to visible light in the phosphor layer 26. Rather, a portion of UV light 38 may pass through phosphor layer 26 unconverted. Due to the composition of fourth layer 30, which is transmissive to visible light and reflective to UV light, the unconverted portion of UV light 38 is directed back to the phosphor layer 26, exciting the layer and creating additional visible light 42, which can pass through substrate 24 and fourth layer 30. This visible light 42 will not pass back into the housing 14, due to the visible light reflective characteristics of the third layer or coating 28.

It is to be appreciated that the transmissive characteristics of the substrate layer 24 and/or the fourth layer 30 may be configured to include filtering which allows specific wavelengths of visible light through. By this design, a variety of lighting colors and levels may be obtained.

Cover 22 may be designed to include a cover integrity sensor 46 that senses the integrity of the cover 22 for a monitor 48. Cover integrity sensor 46 may comprise, for example, a transparent resistive track. The resistive track may be in the form of, for example, a serpentine pattern or a spiral. The integrity sensor 46 and monitor 48 are used to depower the system 10 and/or inform a technician that the cover 22 is broken. If the cover is broken harmful ultraviolet energy could escape from the housing, if the system were activated. Other portions of the luminaire may also have integrity sensors applied to them.

Figure 2:
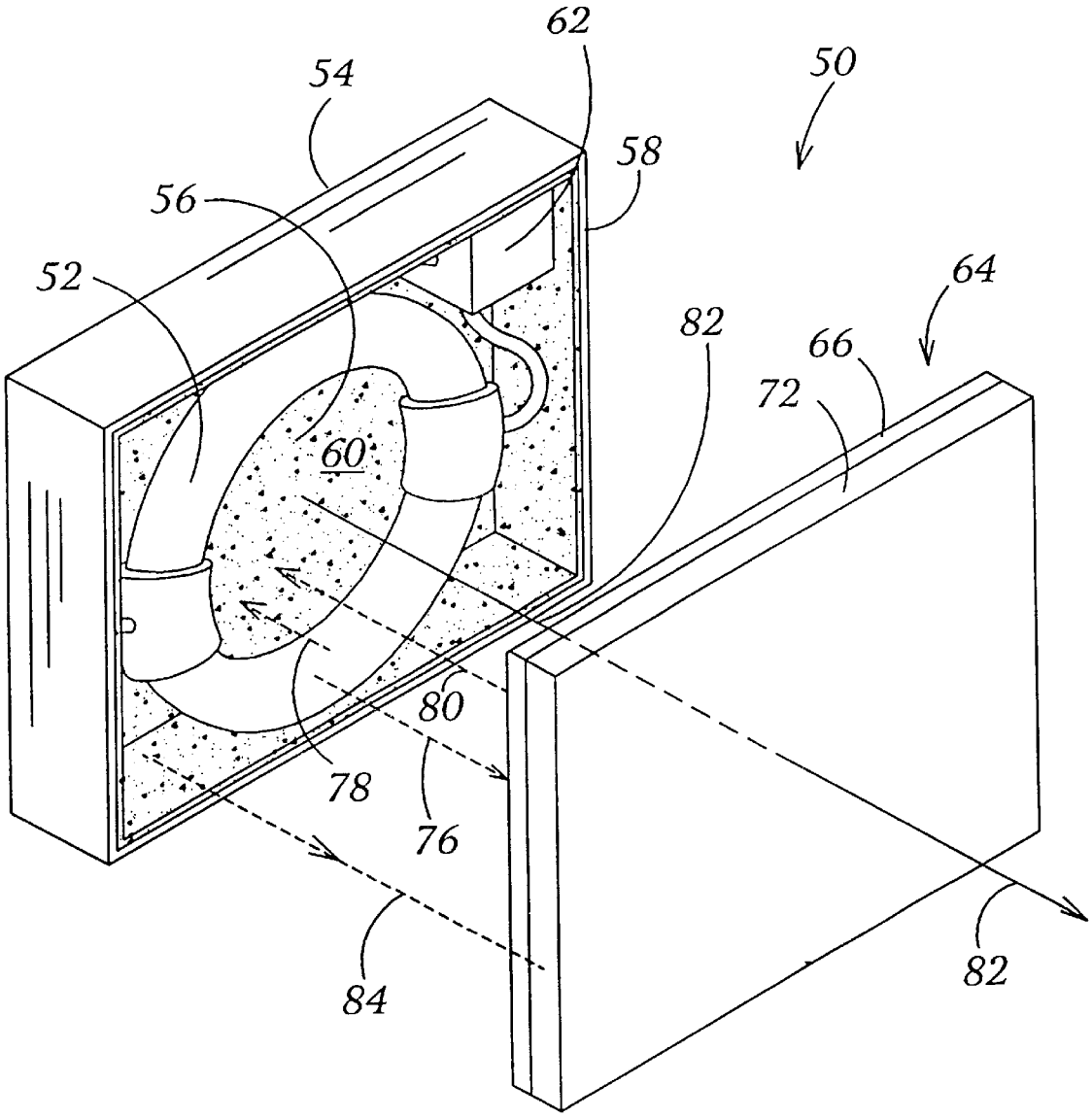
FIG. 2 illustrates a second lamp system that is an embodiment of the present invention, including a housing/reflector and a cover with a phosphor layer on an inner surface of the enclosure and an ultraviolet reflective/visible light transmissive layer on the outer side of the cover.

Referring now to FIG. 2, a second embodiment of a lighting system 50 is depicted, including a discharge lamp 52, similar to that described in FIG. 1, and a housing or reflector 54 having at least a backwall 56 and sidewalls 58. At least some portions of backwall 56 and/or sidewalls 58 are coated with a phosphor 60. A further part of lighting system 50 is an electronic circuit 62 and a cover 64. The circuit 62 may be a ballast circuit, and preferably a plug-in type ballast such as described in FIG. 1, connected to lamp 52 in order to provide energy for operation of lamp 52.

In the second embodiment, cover 64 is a two-layered component. The first layer 66 comprises a UV-reflective/visible light transmissive layer or coating. A substrate or second layer 72 comprises material that is transmissive to visible light and is UV light absorbing. As described in relation to FIG. 1, the substrate 72 has an inner and outer surface with respect to the lamp 52.

Once lamp 52 is activated, substantially pure UV light is emitted Such light may be emitted in a path directly to cover 64, such as illustrated as line 76 or may be emitted back towards back wall 56 or sidewalls 58, as depicted by line 76.

In operation, when the substantially pure UV light, 76 is emitted towards cover 64, the UV-reflective layer or coating 66 causes the UV light 76 to be reflected back into housing 54, as represented by line 80, where it impinges on the phosphor 60. The visible light that is generated by the impinging of the reflected UV light 80 and the directly impinging UV light 78 generates visible light 82, which passes through the first layer 66. The visible light 82 will also exit the substrate or second layer 72 due to its visible light transmissive characteristics.

It is to be appreciated that some UV light may, undesirably, pass through the first layer 66 into second layer 72, as represented by line 84. The UV-absorbing characteristic of the substrate 72 prevents this UV light 84 from leaving the enclosure.

Similar to the embodiment of FIG. 1, appropriate lockout devices, sensors and monitors can be provided such that lamp 52 will not be activated when the cover 64 is not in place, or is broken.

Figure 3:
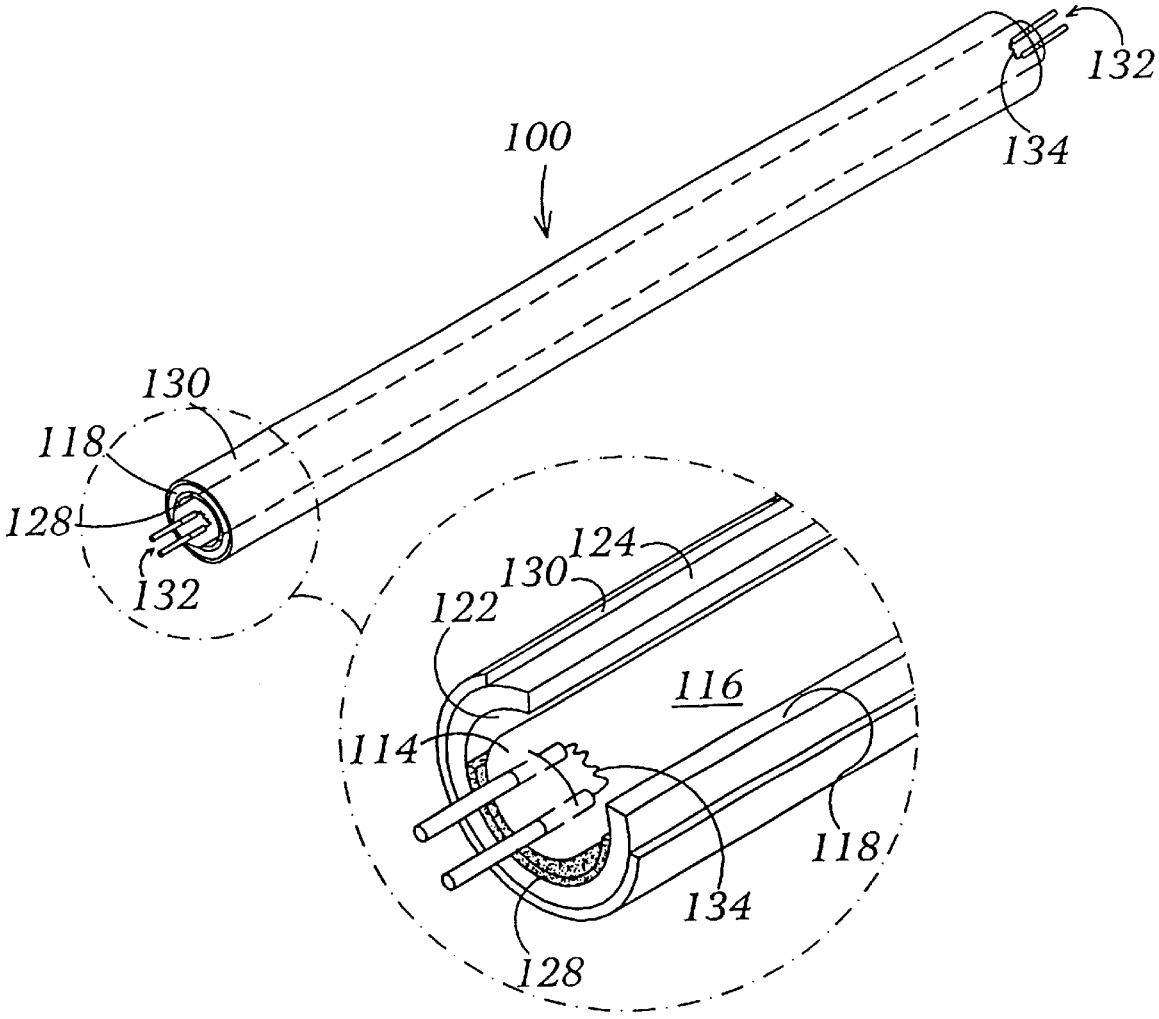
FIG. 3 illustrates a third lamp system that is an embodiment of the present invention, an inset shows the details of a jacket with a coating and a layer with portions cut away for clarity.

Referring to FIG. 3, a third embodiment of a lighting system 100 according to the present invention is set forth. In this third embodiment, the concepts set forth in connection with FIGS. 1 and 2 are implemented with a straight fluorescent tube design. A discharge lamp 114, of an ordinary ultraviolet producing type, has a lamp outer surface 116 and is surrounded by an outer jacket or sleeve 118 having an inner surface 122 and an outer surface 124. The inner surface 122 is defined as the surface closer to the lamp and the outer surface 124 is defined as the surface further from the lamp. A phosphor coating 128 is sandwiched between the outer jacket and the discharge lamp 114. The outer jacket 118 and its coatings are not shown to scale. The outer jacket 118 normally conforms more closely to the outer dimensions of the discharge lamp. The phosphor coating 128 is preferable applied to the inner surface 122 of the outer jacket 118 but may be applied to the lamp outer surface 116, either in addition to, or instead of the coating on the inner surface 122 of the outer jacket 118. The outer jacket is necessarily made of a material that is transmissive of visible light. It may however include filtering aspects that favor the transmission of certain wavelengths or colors and restrict the transmission of others. The outer surface 124 of the outer jacket 118 has an ultraviolet reflective/visible light transmissive layer 130. The ultraviolet reflective/visible light transmissive layer 130 reflects ultraviolet light that passes through the phosphor without being converted to visible light, back to the phosphor coating, thereby improving lamp efficiency and protecting a user from harmful ultraviolet light. At the same time, the ultraviolet reflective/visible light transmissive layer allows visible light created in the phosphor to pass through and light an area to be lit.

Instead of carrying the ultraviolet reflective/visible light transmissive layer 130 on it's outer surface it may carry the layer on its inner surface or the outer jacket 118 may instead simply be comprised of the ultraviolet reflective/visible light transmissive layer 130.

The lamp of FIG. 3 is energized through electrodes 132 and filaments 134. Therefore, it may suffer from filament evaporation and eventual failure. A longer-lived lamp system can be achieved through the use of an electrodeless discharge lamp.

Figure 4:
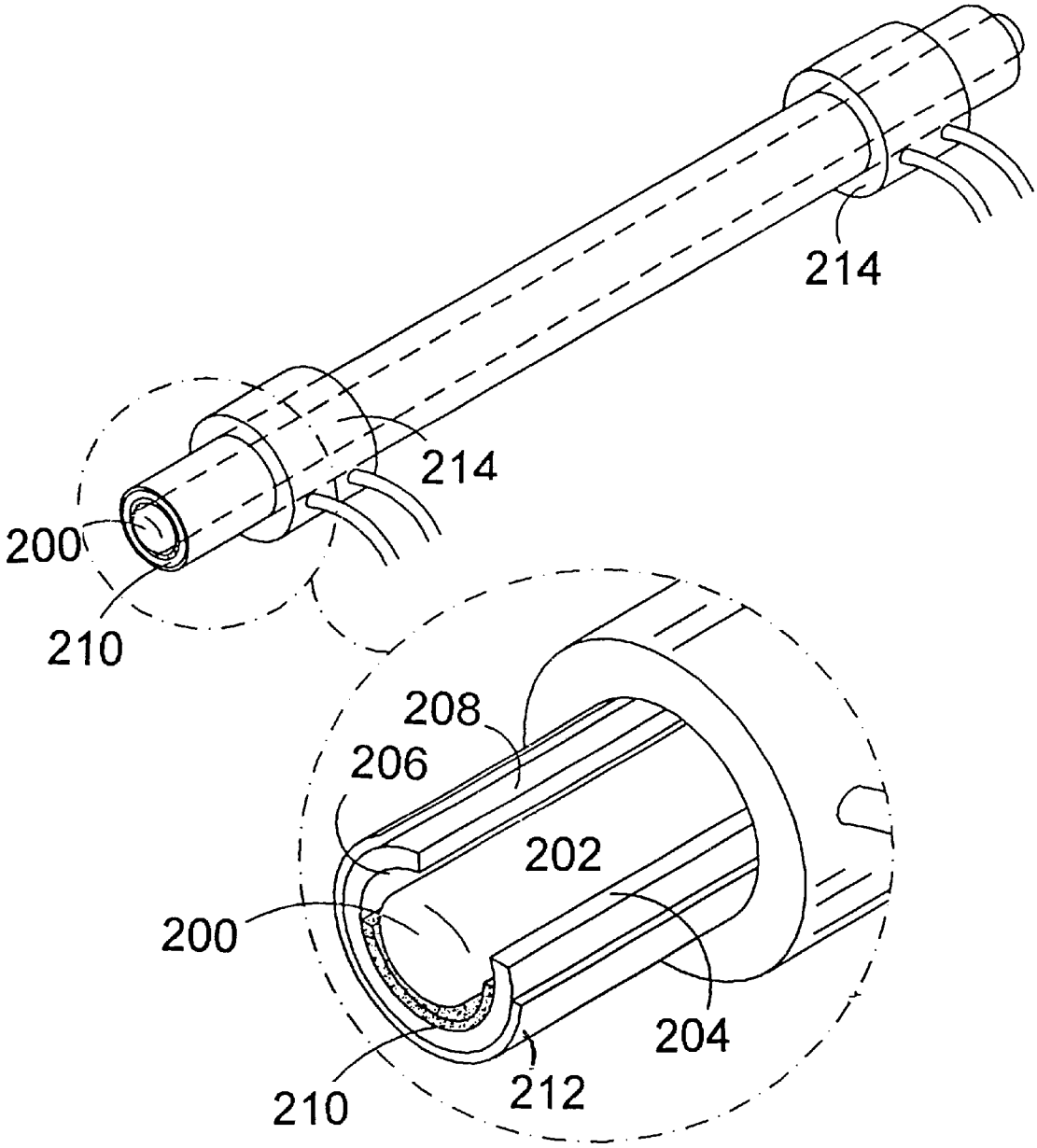
FIG. 4 illustrates a forth lamp system that is an embodiment of the present invention similar to that of FIG. 3, further including an electrodeless discharge lamp, an inset shows the details of a jacket with a coating and a layer with portions cut away for clarity.

Referring now to FIG. 4, a discharge lamp 204, of an electrodeless ultraviolet producing type, has a lamp outer surface 202 and is surrounded by an outer jacket or sleeve 204 having an inner surface 206 and an outer surface 208. As described with reference to FIG. 3, the inner surface 206 is defined as the surface closer to the lamp and the outer surface 208 is defined as the surface further from the lamp 200. A phosphor coating 210 is sandwiched between the outer jacket 204 and the discharge lamp 200. The outer surface 208 of the outer jacket 218 has an ultraviolet reflective/visible light transmissive layer 212. The ultraviolet reflective/visible light transmissive layer 212 reflects ultraviolet light that passes through the phosphor without being converted to visible light, back to the phosphor coating, thereby improving lamp efficiency and protecting a user from harmful ultraviolet light. At the same time, the ultraviolet reflective/visible light transmissive layer 212 allows visible light created in the phosphor to pass through and light an area to be lit. Energy can be induced into the discharge lamp 200 via induction coils 214 mounted on either end of the discharge lamp 200. The coils can be driven by lamp drive electronics (not shown) at any suitable excitation frequency. An example of a typical excitation frequency is 250 Khz. The excitation frequency is not critical. Other excitation frequencies are anticipated. Examples of other possible excitation frequencies range from about 10 Khz to 250 Mhz and beyond. The excitation frequency is selected to optimize the performance of various lamp designs and minimize radio frequency interference.

The invention has been described with reference to the preferred embodiments. Obviously, modifications and alterations will occur to others upon reading and understanding the preceding detailed description. It is intended that the invention be construed as including all such modifications and alterations insofar as they come with the scope of the appended claims or equivalents thereof.

What is claimed is:

1. A fluorescent lamp system for lighting a space comprising:

a discharge lamp for producing ultraviolet light;

a phosphor coating external of the discharge lamp for converting ultraviolet light to visible light;

an ultraviolet reflective/visible light transmissive layer between the phosphor coating and the space to be lit; and an outer jacket having an inner and an outer surface, the outer jacket surrounding the discharge lamp, the inner surface defined as the surface closer to the discharge lamp and the outer surface defined as the surface further from the discharge lamp.

2. The fluorescent lamp system of claim 1 wherein the phosphor coating is on the inner surface of the outer jacket.

3. The fluorescent lamp system of claim 1 wherein the phosphor coating is on the outer surface of the discharge lamp.

4. The fluorescent lamp system of claim 1 wherein the ultraviolet reflective/visible light transmissive layer is on the outer surface of the outer jacket.

5. The fluorescent lamp system of claim 1 wherein the outer jacket comprises:

an ultraviolet reflective/visible light transmissive layer.

6. The fluorescent lamp system of claim 1 wherein the discharge lamp further comprises:

an electrodeless discharge lamp.

7. A fluorescent lamp system for lighting a space comprising:

a discharge lamp for producing ultraviolet light;

a phosphor coating external of the discharge lamp for converting ultraviolet light to visible light;

an ultraviolet reflective/visible light transmissive layer between the phosphor coating and the space to be lit;

a housing for mounting the discharge lamp in, the housing having a back wall, at least one side wall, and an opening, each wall having an inner and outer surface, and a cover for closing the opening, the cover comprised of a substrate, the substrate including inner surface, and an outer surface, the inner surface defined as the surface mounted closest to the discharge lamp and the outer surface defined as the surface mounted furthest from the discharge lamp, the substrate operative to carry the ultraviolet reflective/visible light transmissive layer on one of the inner surface and the outer surface.

8. The fluorescent lamp system of claim 7 where in the phosphor coating is on the inner surface of at least one of the back wall and the at least one side wall.

9. The fluorescent lamp system of claim 7 wherein the cover further comprises:

the phosphor coating on at least one of the inner surface and the outer surface of the substrate;

an ultraviolet transmissive/visible light reflective layer on the inner surface of the substrate and any phosphor coating on the inner surface, and the ultraviolet reflective/visible light transmissive layer over the outer surface of the substrate and any phosphor on the outer surface of the substrate.

10. The fluorescent lamp system of claim 7 further comprising:

a plug in ballast.

11. The fluorescent lamp system of claim 7 further comprising:

at least one integrity sensor.

12. The fluorescent lamp system of claim 7 wherein the discharge lamp further comprises:

an electrodeless discharge lamp.

13. A fluorescent lamp luminaire system comprising:

a reflector having a front facing portion for reflecting light and a cavity portion for receiving a discharge lamp;

a discharge lamp for producing ultraviolet light, the lamp mounted within the cavity portion of the reflector;

a substrate mounted in front of the front facing portion of the reflector, the substrate having an inner surface for facing the discharge lamp and reflector and an outer surface for facing away from the discharge lamp and reflector;

a phosphor coating deposited on at least one of an inner surface of the reflector, the inner surface of the substrate, and the outer surface of the substrate, and an ultraviolet reflecting/visible light transmissive layer, mounted on a surface selected from the inner surface of the substrate and the outer surface of the substrate, over the phosphor coating if the phosphor coating is on the selected surface of the substrate, or directly on the surface of the substrate if the phosphor coating is elsewhere.

14. The fluorescent lamp luminaire system of claim 13 further comprising:

a lockout device for preventing lamp operation if the substrate is not in place, and an integrity sensor for preventing lamp operation if at least one critical portion of the luminaire is not intact.

15. The fluorescent lamp luminaire system of claim 13 further comprising:

an ultraviolet transmissive/visible light reflective layer mounted on the inner surface of the substrate, over the phosphor coating, if the phosphor coating is on the inner surface, or directly on the surface of the substrate if the phosphor coating is elsewhere, and the ultraviolet reflective/visible light transmissive layer mounted on the outer surface of the substrate, over the phosphor coating if the phosphor coating is on the outer surface of the substrate, or directly on the surface of the substrate if the phosphor coating is elsewhere.

16. The fluorescent lamp luminaire system of claim 13 further comprising:

a plug-in type electronic circuit for powering the discharge lamp, removably connected to the discharge lamp.

17. The fluorescent lamp luminaire system of claim 13 wherein the substrate is made of glass.

18. The fluorescent lamp luminaire system of claim 13 wherein the substrate is made of quartz.

* * * * *